United States Patent [19]

Watabe et al.

[11] 4,132,477

[45] Jan. 2, 1979

[54] OPTICAL IMAGING SYSTEM FOR ELECTROPHOTOGRAPHY

[75] Inventors: Rokuro Watabe; Makoto Ohira; Katsuo Sakai, all of Tokyo, Japan

[73] Assignee: Ricoh Company, Ltd., Tokyo, Japan

[21] Appl. No.: 754,045

[22] Filed: Dec. 23, 1976

[30] Foreign Application Priority Data

Dec. 27, 1975 [JP] Japan ..... 50-177411[U]

[51] Int. Cl.[2] ..... G03G 15/00

[52] U.S. Cl. ..... 355/11; 355/30; 355/71; 355/66

[58] Field of Search ..... 355/11, 3 R, 65, 66, 355/71, 30; 350/290

[56] References Cited

U.S. PATENT DOCUMENTS

| | | | |
|---|---|---|---|
| 2,229,284 | 1/1941 | Fassin | 355/30 |
| 3,143,921 | 8/1964 | Russell | 355/71 X |
| 3,527,974 | 9/1970 | Cooper | 350/290 X |
| 3,858,976 | 1/1975 | Brooke | 355/66 |

*Primary Examiner*—Richard L. Moses
*Attorney, Agent, or Firm*—Frank J. Jordan

[57] ABSTRACT

A converging lens projects a light image of an original document along an optical path onto the surface of a photoconductive drum. A dichroic mirror is disposed in the optical path to reflect the light image and has a reflectance characteristic selected in accordance with the spectral sensitivity characteristic of the drum. Unwanted wavelengths are transmitted through the dichroic mirror and absorbed by an absorption plate. The dichroic mirror and absorption plate are housed in a hermetically sealed casing with the converging lens being fixed to and constituting a portion of the casing.

8 Claims, 9 Drawing Figures

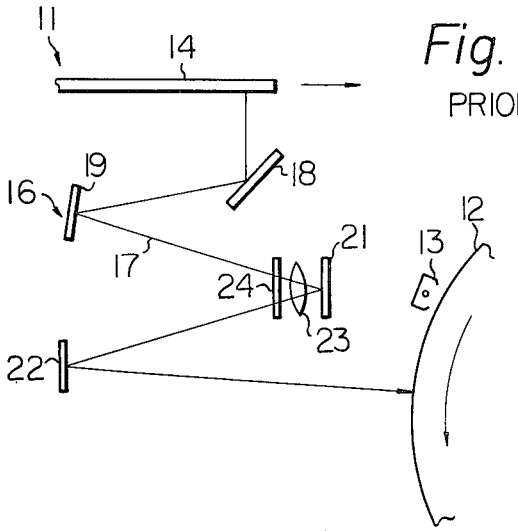
Fig. 1
PRIOR ART
Fig. 2
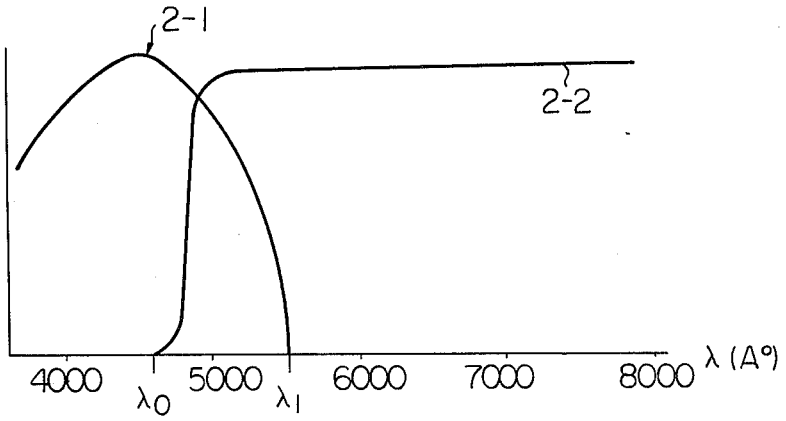
Fig. 3
PRIOR ART
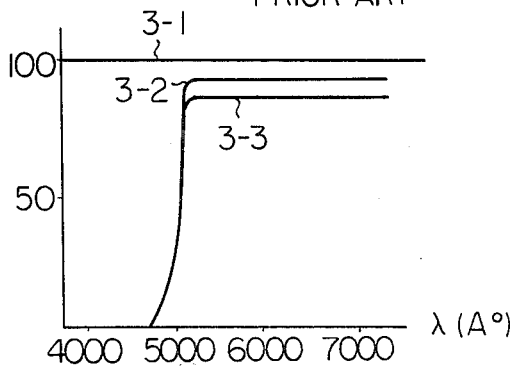

OPTICAL IMAGING SYSTEM FOR ELECTROPHOTOGRAPHY

BACKGROUND OF THE INVENTION

The present invention relates to an optical imaging system for electrophotography.

In a typical electrophotographic apparatus, a converging lens projects a light image of an original document along an optical path onto a photoconductive drum or belt. Prior to this imaging operation the drum is electrostatically charged and the light image causes localized photoconduction which results in the formation of an electrostatic image on the drum. A toner substance is applied to the drum which produces a toner image which is transferred and fixed to a copy sheet to provide a permanent copy of the original document.

Whereas known apparatus of this type are capable of producing acceptable copies of black and white documents, the quality of reproduction of colored documents is dependent on the colors of the documents. More specifically, the photoconductive coating on the drum has a spectral sensitivity characteristic such that the sensitivity of the coating for various wavelongths of light differs greatly. Such coatings are especially sensitive to blue light, and the sensitivity to orange and red light may be close to zero. Whereas a document with a white background and red printing would be reproduced with good contrast, a copy of a blueprint would be almost completely white since the spectral sensitivity of the coating for blue light is almost as great as for white light. Attempts to overcome this problem, especially to increase the spectral sensitivity for red light comprise the addition of a suitable sensitizing substance to the coating which makes it more sensitive to red light. Suitable additives have not yet been produced, however, which will both increase the sensitivity to red light and decrease the sensitivity to blue light to the required extent.

The expendient which is currently employed in order to obtain satisfactory reproductions of blueprints and other documents comprising blue areas is to place a suitable filter in the optical path of the converging lens. However, while sufficient contrast is obtained using this method, the amount of light lost through absorption by the filter is a serious problem which has heretofore remained unsolved.

Where two filters are used together for sensitivity compensation of a photoconductive coating which has been sensitized for red light, the amount of light loss may be greater than 30%.

SUMMARY OF THE INVENTION

In brief, the present invention constitutes an improvement to an electrophotographic apparatus in which a light image of an original document is projected along an optical path by a converging lens onto the surface of a photoconductive drum. A dichroic mirror is disposed in the optical path to reflect the light image and has a reflectance characteristic selected in accordance with the spectral sensitivity characteristic of the drum. Unwanted wavelengths are transmitted through the dichroic mirror and absorbed whereas the usable image is reflected from the dichroic mirror to the drum. The light loss of the dichroic mirror is only on the order of 5%.

It is an object of the present invention to provide an optical imaging system for electrophotography which effectively compensates for the non-uniform spectral sensitivity characteristic of a photoconductive coating on a drum or belt but does not significantly decrease the intensity of the light image.

It is another object of the present invention to provide an optical imaging system for electrophotography which utilizes a dichroic mirror in a unique optical arrangement.

It is another object of the present invention to provide a generally improved optical imaging system for electrophotography.

Other objects, together with the foregoing, are attained in the embodiment described in the following description and illustrated in the accompanying drawings.

BRIEF DESCRIPTION OF THE DRAWING

FIG. 1 is a simplified schematic view of a prior art electrophotographic apparatus;

FIG. 2 is a graph illustrating the spectral sensitivity characteristic of a photoconductive drum and the transmittance characteristic of an optical filter used in the prior art to compensate for the spectral sensitivity characteristic;

FIG. 3 is a graph showing the transmittance characteristics of filters used in the prior art;

DESCRIPTION OF THE PREFERRED EMBODIMENT

Figure 4:
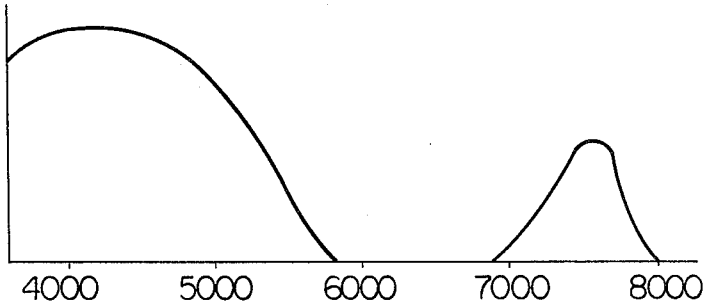
FIG. 4 is a graph showing the spectral sensitivity characteristic of another type of photoconductive drum.

While the optical imaging system for electrophotography of the invention is susceptible of numerous physical embodiments, depending upon the environment and requirements of use, substantial numbers of the herein shown and described embodiment have been made, tested and used, and all have performed in an eminently satisfactory manner.

Referring now to FIG. 1 of the drawing, a prior art electrophotographic apparatus is generally designated by the reference numeral 11 and comprises a rotary drum 12 formed with a photoconductive surface coating or layer. The drum 12 is driven for counterclockwise rotation at constant speed adjacent to a corona charging unit 13 which changes the surface of the drum 12 to an electrostatic potential.

In synchronism with the rotation of the drum 12 an original document 14 is fed rightwardly by means of a carriage which is not shown. An optical imaging system which is generally designated as 16 projects a light image of the original document 14 along an optical path 17 onto the surface of the drum 12. The ligh image causes localized photoconduction at the surface of the drum 12 which results in the formation of an electrostatic image. A toner substance is applied to the drum 12 thereby producing a toner image which is transferred and fixed to a copy sheet to provide a permanent copy of the original document 14 although the means for effecting these operations are not the subject matter of the present invention and are not shown.

The optical system 16 comprises plane mirrors 18, 19, 21 and 22 and a converging lens 23. The light image is reflected from the mirror 18 onto the mirror 19, from the mirror 19 through the converging lens 23 onto the mirror 21, from the mirror 21 through the converging lens 23 onto the mirror 22 and from the mirror 22 onto the photoconductive drum 12. The optical system 16 which is shown in FIG. 1 is desirable in that it enables a compact configuration, especially since the light image passes through the converging lens 23 twice and is therefore converged twice.

In FIG. 2 the abscissa axis represents wavelength of light and the ordinate axis represents relative light intensity. A curve 2-1 represents the spectral sensitivity characteristic of the photoconductive drum 12. It will be noted that the drum 12 is insensitive to light above a wavelength $\lambda_1$ which is about 5500Å and corresponds to green light. However, the sensitivity to blue light centered about a wavelength of about 4500Å is extremely high. For this reason, the contrast of copies of blueprints will be extremely low and in some cases the copies may even be intelligible.

A curve 2—2 of FIG. 2 shows the transmittance characteristic for white light of a filter 24 which is shown in FIG. 1 and used to reduce the sensitivity of the drum 12 to blue light to the extent that usable copies of blueprints may be obtained. The filter 24 completely absorbs light of wavelengths shorter than $\lambda_0$ which is about 4500Å. However, the transmittance of wavelengths above $\lambda_0$ is essentially constant and has a value of about 92%.

However, in the optical system 16 the filter 24 is disposed so that the light image passes therethrough twice. The effective transmittance is therefore only 84%. This is illustrated in FIG. 3 where a curve 3-1 shows the intensity of white light taken as 100%, a curve 3-2 shows the intensity of the light passed through the filter 24 once and a curve 3-3 shows the intensity of the light passed through the filter 24 twice.

In addition to the drawback of light loss the filter 24 must be made optically flat in order to avoid distortion and is therefore an expensive item.

Figure 5:
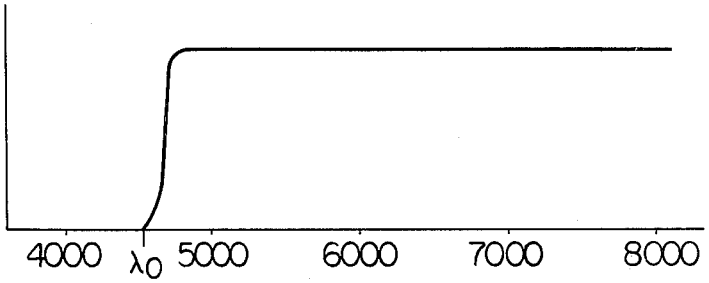
Fig. 5 PRIOR ART
FIGS. 5 and 6 show the transmittance characteristics of filters used in the prior art.
Figure 6:
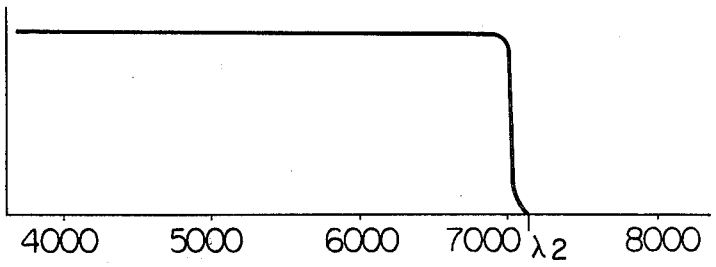
Fig. 6 PRIOR ART

FIG. 4 shows the spectral sensitivity of another type of photoconductive drum (not shown) in which the photoconductive coating comprises a sensitizer to make the drum sensitive to red light centered about a wavelength of about 7500Å. FIG. 5 shows the transmittance characteristic of a filter (not shown) to reduce the spectral sensitivity of the drum for blue light in order to obtain sufficient contrast for reproductions of blueprints and similar original documents having blue areas. The cutoff wavelength in FIG. 5 is also $\lambda_0$. FIG. 6 shows the spectral characteristic of a filter (not shown) to reduce the spectral sensitivity of the drum to red light sufficiently to obtain acceptable contrast in copies of original documents having red areas. In FIG. 6 all wavelengths greater than $\lambda_2$ which is about 7200Å are totally absorbed.

Figure 7:
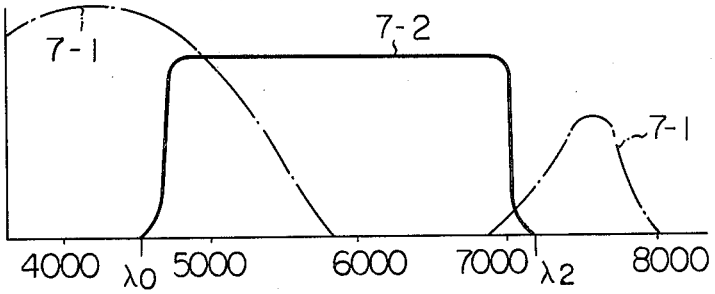
FIG. 7 is a graph showing the combined effect of the filters of FIGS. 5 and 6.

FIG. 7 illustrates the effect obtained by using the filters represented by FIGS. 5 and 6 together. A curve 7-1 is essentially similar to the curve of FIG. 4 and a curve 7-2 represents the composite effect of the curves of FIGS. 5 and 6. It will be noted that all wavelengths shorter than $\lambda_0$ and all wavelengths longer than $\lambda_2$ are totally absorbed. In this manner, acceptable reproductions of original documents having both blue and red acreas may be obtained.

However, the two filters in combination absorb approximately 32% of the usable light so that only 78% is available for imaging. In addition, the two filters double the possibility of distortion and must be made even more optically flat than if only one filter is used.

Figure 8:
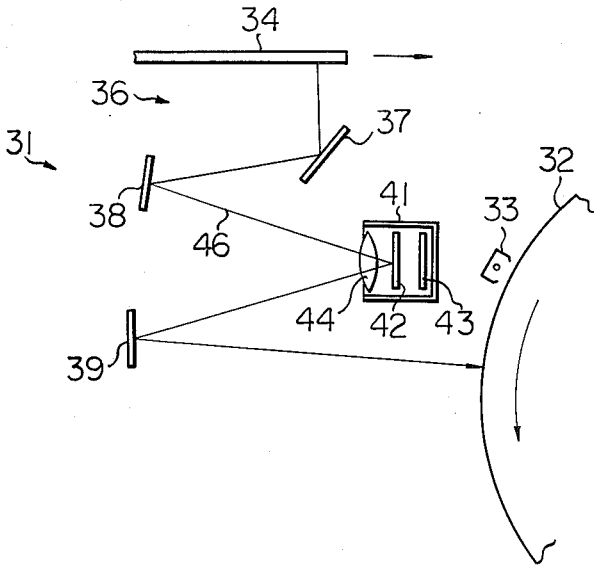
FIG. 8 is a simplified schematic view of an electrophotographic apparatus embodying the present invention.

These drawbacks are overcome in an electrophotographic apparatus 31 of the present invention which is illustrated in FIG. 8. The apparatus 31 comprises a photoconductive drum 32 which is driven for counterclockwise rotation adjacent to a charging unit 33 in the same manner as the prior art. An original document 34 is moved rightwardly in synchronism with the rotation of the drum 32. An optical imaging system 36 comprises plane mirrors 37, 38 and 39 and a casing 41 which supports therein a dichroic mirror 42. A light absorption plate 43 is mounted in the casing 41 behind or to the right of the dichroic mirror 42 and a converging lens 44 is fitted to the left open end of the casing 41. The casing 41 and lens 44 cooperate to hermetically seal the dichroic mirror 42 and absorption plate 43 therein with the converging lens 44 constituting a portion of the casing 44. A light image of the original document 34 is projected by the optical system 36 along an optical path 46 onto the surface of the drum 32.

The light image is reflected from the mirror 37 onto the mirror 38, reflected from the mirror 38 through the converging lens 44 onto the dichroic mirror 42, reflected from the dichroic mirror 42 through the converging lens 44 onto the mirror 39 and reflected from the mirror 39 onto the drum 32. The light image is converged once as it is reflected from the mirror 38 through the converging lens 44 onto the dichroic mirror 42 and converged again as it is reflected from the dichroic mirror 42 through the converging lens 44 onto the mirror 39.

Figure 9:
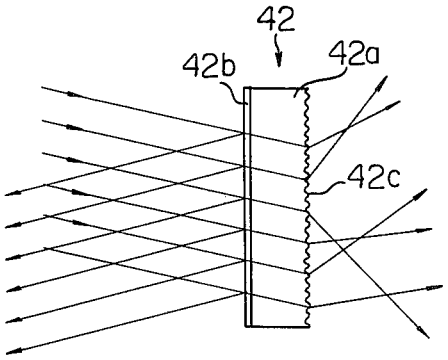
FIG. 9 is a schematic view of a dichroic mirror of the present apparatus.

The dichroic mirror 42 is shown in FIG. 9 in greater detail, and comprises an optically flat transparent glass or plastic plate **42*a* which is formed with a front dichroic surface layer 42*b* which faces the converging lens 44. The back or opposite surface 42*c* of the plate 42*a*** is ground or otherwise processed to be light diffusing, or to diffuse light passing therethrough.

The dichroic layer **42*b* is formed of a metallic film by vacuum evaporation, ion plating or the like and serves to selectively reflect certain wavelengths of light while transmitting others as indicated by arrows in FIG. 9. The light transmitted through the dichroic layer 42*b* and plate 42*a* are diffused by the diffusing surface 42*c* and absorbed by the absorption plate 43**.

The reflectance characteristic of the dichroic layer **42*b* is selected in accordance with the spectral sensitivity characteristic of the drum 32 so as to allow good copies to be made of colored original documents. The present level of technology allows the reflectance characteristic of the dichroic layer 42*b* to be controllably selected within wide limits. Whereas the drum 32 has the spectral sensitivity characteristic corresponding to curve 2-1 in FIG. 2, the reflectance characteristic of the dichroic layer 42*b* is selected to be similar to the curve 2—2 of FIG. 2 in that wavelengths below $\lambda_0$ are transmitted through the plate 42*a* and prevented from reaching the drum 32. However, the reflectance of the dichroic layer 42*b* for wavelengths above $\lambda_0$ is on the order of 95% rather than 84% so that much more usable image light is reflected to the drum 32 than if the filter 24** were employed.

Where the drum 32 has a spectral sensitivity corresponding to the curve 7-1 of FIG. 7, the dichroic layer **42*b* is formed so as to transmit wavelengths below $\lambda_0$ and above $\lambda_2$ so that only wavelengths between $\lambda_0$ and $\lambda_2$ are reflected onto the drum 32, aimilarly to the curve 7-2 of FIG. 7. However, the reflectance of the dichroic layer 42*b* is about 95% rather than 78%, and much more usable light reaches the drum 32** than if two filters were used in combination.

The apparatus 31 embodies many substantial improvements over the apparatus 11. The dichroic mirror 42 must have only one (the front) optically flat surface rather than two in the case of a filter and is therefore inexpensive to manufacture. The loss of usable light is much less than if one or two filters are used. Although a dichroic mirror may be used as one or more of the mirrors 37, 38 or 39 rather than in the configuration shown and described, the optical system 36 is especially advantageous in that the dichroic mirror 42 is smaller than the mirrors 37, 38 and 39 and can therefore be manufactured more inexpensively. In addition, the casing 41 and lens 44 hermetically seal the dichroic mirror 42 therewithin to prevent contamination and deterioration of the dichroic layer **42*b*. The present apparatus 31** is able to satisfactorily reproduce magneta, a combination of blue and red, which is proctically impossible in prior art apparatus and may be quite advantageously adapted to color electrophotography.

Many modifications will become possible for those skilled in the art after receiving the teachings of the present disclosure without departing from the scope thereof.

What is claimed is:

1. In an electrophotographic apparatus including a photoconductive member and a converging lens for projecting a light image of an original document along an optical path onto the photoconductive member, a dichroic mirror disposed in the optical path for reflecting the light image and having a reflectance characteristic selected in accordance with the spectral sensitivity of the photoconductive member, the dichroic mirror comprising a transparent plate formed with a dichroic front reflecting surface and a back diffusing surface, and a light absorbing member disposed adjacent to the back surface layer of the dichroic mirror.

2. An apparatus as in claim 1, in which the converging lens and the dichroic mirror are oriented such that the light image is converged by the converging lens onto the dichroic mirror, reflected from the dichroic mirror back to the converging lens and converged further by the converging lens onto the photoconductive member.

3. An apparatus as in claim 1, further comprising a hermetically sealed casing supporting the dichroic mirror and light absorbing member, the converging lens being fixed to and constituting a portion of the casing.

4. An apparatus as in claim 1 in which the dichroic mirror is formed so as to reflect light only within the approximate wavelength range of 4000Å to 7250Å.

5. An apparatus as in claim 1 in which the dichroic mirror is formed so as to reflect light only of a wavelength greater than approximately 4500Å.

6. An apparatus as in claim 1, in which the photoconductive member comprises a rotary drum.

7. An apparatus as in claim 1, in which the light absorbing member comprises a plate.

8. In an electrophotographic apparatus including a photoconductive member and a converging lens for projecting a light image of an original document along an optical path onto the photoconductive member, a dichroic mirror disposed in the optical path for reflecting the light image and having a reflectance characteristic selected in accordance with the spectral sensitivity of the photoconductive member, means for absorbing unwanted wave lengths transmitted through the dichroic mirror, and a hermetically sealed casing supporting the dichroic mirror and absorbing means.

* * * * *